US012405032B1

(12) United States Patent
Gao et al.

(10) Patent No.: US 12,405,032 B1
(45) Date of Patent: Sep. 2, 2025

(54) OPTIMAL OPERATION CONTROL METHOD OF AIR-SOURCE HEAT PUMP AND GAS-FIRED HEATER COMBINED HEATING SYSTEM

(71) Applicant: NORTH CHINA MUNICIPAL ENGINEERING DESIGN & RESEARCH INSTITUTE CO., LTD., Tianjin (CN)

(72) Inventors: Wenxue Gao, Tianjin (CN); Lin Yang, Tianjin (CN); Yan Wang, Tianjin (CN); Rongsong Yan, Tianjin (CN); Yingjie Hu, Tianjin (CN); Qingwei Miao, Tianjin (CN); Mingchang Yang, Tianjin (CN)

(73) Assignee: NORTH CHINA MUNICIPAL ENGINEERING DESIGN & RESEARCH INSTITUTE CO., LTD., Tianjin (CN)

( * ) Notice: Subject to any disclaimer, the term of this patent is extended or adjusted under 35 U.S.C. 154(b) by 0 days.

(21) Appl. No.: 19/050,582

(22) Filed: Feb. 11, 2025

(30) Foreign Application Priority Data

Jul. 18, 2024 (CN) ..... 202410962287.X

(51) Int. Cl.
*F24H 15/148* (2022.01)
*F24H 15/16* (2022.01)
(Continued)

(52) U.S. Cl.
CPC ..... *F24H 15/148* (2022.01); *F24H 15/16* (2022.01); *F24H 15/258* (2022.01); *F24H 15/414* (2022.01)

(58) Field of Classification Search
CPC ... H04L 43/18; H04L 41/0686; H04L 67/566; H04L 67/568
See application file for complete search history.

(56) References Cited

U.S. PATENT DOCUMENTS

2010/0077779 A1* 4/2010 Pearson ..... F24D 3/18 62/238.7

FOREIGN PATENT DOCUMENTS

CN 113780759 A 12/2021
CN 217057693 U 7/2022
(Continued)

OTHER PUBLICATIONS

Wu et al., Performance analysis and optimization for a novel air-source gas-fired absorption heat pump;Sep. 5, 2020, Energy Conversion and Management , p. 1-14. (Year: 2020).*
(Continued)

*Primary Examiner* — Kidest Bahta

(57) ABSTRACT

The present disclosure discloses an optimal operation control method of the air-source heat pump and gas-fired heater combined heating system, including constructing a mathematical model of the air-source heat pump and gas-fired heater combined heating system to simulate real time energy consumption; determining a comprehensive evaluation index system of the combined heating system, including primary evaluation indexes of energy conservation, environmental protection and economical efficiency, and secondary evaluation indexes of EER, clean energy utilization rate, carbon dioxide emission and operation cost; calculating indexes through an analytic hierarchy process and then constructing a comprehensive objective function, to determine operation mode when the comprehensive objective function is the maximum by taking the priority of meeting the heating requirement as a principle, so as to achieve the purpose of optimizing the combined heating system, and achieve the combined heating system efficient, energy-saving and environmental protection.

4 Claims, 5 Drawing Sheets

(51) Int. Cl.
*F24H 15/258* (2022.01)
*F24H 15/414* (2022.01)

(56) References Cited

FOREIGN PATENT DOCUMENTS

| | | | | | |
|---|---|---|---|---|---|
| CN | 115574487 | A | | 1/2023 | |
| CN | 219454050 | U | | 8/2023 | |
| JP | H02-52958 | A | * | 2/1990 | ..... F25B 13/00 |
| KR | 20130128661 | A | | 11/2013 | |

OTHER PUBLICATIONS

Cheng et al., Design and Optimization of a Hybrid Energy System for Decentralized Heating, Oct. 9, 2020, Tech Scirnce Press, p. 1-22. (Year: 2020).*

Park et al., Performance investigation of heat pump-gas fired water heater hybrid system and its economic feasibility study, Jun. 5, 2014, http://www.elsevier.com/locate/enbuild, p. 1-10, (Year: 2014).*

Yong Wu et al., "An equivalent temperature drop method for evaluating the operating performances of ASHP units jointly affected by ambient air temperature and relative humidity", Department of Building Environment and Facility Engineering et al., Jun. 27, 2020.

Yaoqing Lu, "Practical Heating and Air Conditioning Design Manual", May 2008.

Loïc Cabrol et al. "Towards low carbon homes—a simulation analysis of building-integrated air-source heat pump systems", Centre for Renewable Energy Systems Technology et al., Jan. 13, 2012.

Xiaoping Tang et al. Comparative analysis of Gas-fired heating and hot water combi-boilers and air-source heat pumps in the home heating, Aug. 15, 2016.

* cited by examiner

OPTIMAL OPERATION CONTROL METHOD OF AIR-SOURCE HEAT PUMP AND GAS-FIRED HEATER COMBINED HEATING SYSTEM

CROSS-REFERENCE TO RELATED APPLICATION

This application claims priority from the Chinese patent application 202410962287X filed Jul. 18, 2024, the content of which is incorporated herein in the entirety by reference.

TECHNICAL FIELD

The present disclosure relates to an optimal operation control method of a heating system, in particular to an optimal operation control method of an air-source heat pump and gas-fired heater combined heating system.

BACKGROUND ART

Existing researches have shown that as air-source heat pumps have the frosting problem in cold areas, the heat supply effect is not satisfactory when the air-source heat pumps are used as an independent heat source at low-temperature outdoor. Dual-energy combined heating system, adopting the air-source heat pumps as a primary heat source and adopting gas-fired heaters for heating as a heat source for peak modulation, will become an emerging form of heat supply source systems in northern areas of China. The dual-energy combined heating system fully exert the advantages of energy conservation and emission reduction of the heat pumps under most operating conditions, and can ensure the overall heating effect of the systems when the heat pumps operate under severe operating conditions by means of the gas-fired heaters for heating.

An optimal operation control technology is one of key technologies in multi-heat source combined heating systems in practical applications, which plays an important role in reducing operation cost, saving energy and improving energy efficiency of the systems. Due to the presence of multiple energy forms in multi-energy combined heating systems, various optimization objectives exist, necessitating the modeling for objective functions based on different optimization requirements. Additionally, the production and consumption patterns of energy within the multi-energy combined heating systems vary significantly across temporal and spatial scales. The existing optimization technology is not specific to the air-source heat pump and gas-fired heater combined heating system, and the selection of optimization objective functions fails to comprehensively cover aspects such as energy conservation, environmental protection, and economical efficiency, resulting in relatively simple calculation models.

SUMMARY

The present disclosure provides an optimal operation control method of an air-source heat pump and gas-fired heater combined heating system, which can improve the energy utilization efficiency of the combined heating system, save the cost and realize the high efficiency, energy conservation and environmental protection of the combined heating system.

The optimal operation control method of the air-source heat pump and gas-fired heater combined heating system of the present disclosure includes the following steps:

Step 1. constructing a mathematical model of the air-source heat pump and gas-fired heater combined heating system, and calculating hourly operation performance of the combined heating system; wherein the mathematical model includes a heating capacity and energy consumption model for an air-source heat pump unit, and a heating capacity and energy consumption model for a gas-fired heater unit;

Step 2. determining a comprehensive evaluation index system of the combined heating system, including primary evaluation indexes and secondary evaluation indexes, and constructing a secondary evaluation index calculation model, wherein 3 primary evaluation indexes are provided, including energy conservation, environmental protection and economical efficiency, and 4 secondary evaluation indexes are provided, including a comprehensive energy efficiency ratio (EER) and a clean energy utilization rate ($\eta$) that are subordinate to the energy conservation index, a carbon dioxide emission ($T_{CO2}$) that is subordinate to the environment protection index, and operation cost ($C_r$) that is subordinate to the economical efficiency index;

Step 3. constructing an index determination matrix through an analytic hierarchy process based on the evaluation index system of the combined heating system, carrying out normalization and consistency check, and determining respective weights of the primary evaluation indexes and the secondary evaluation indexes;

Step 4. normalizing the secondary evaluation indexes of the combined heating system, and respectively calculating membership functions of the EER, the clean energy utilization rate, the carbon dioxide emission and the operation cost;

Step 5. a comprehensive objective function calculation model is constructed based on the membership functions of the secondary evaluation indexes, with a calculation formula as follows: $f=w_1(w_{11}\times f_1(EER)+w_{12}\times f_2(\eta))+w_2\times f_3(T_{CO2})+w_3\times f_4(C_r)$, where $w_1$, $w_2$, and $w_3$ denote the weights of the primary evaluation indexes: the energy conservation, the environmental protection and the economical efficiency, respectively; and $w_{11}$ and $w_{12}$ denote the weights of the secondary evaluation indexes: the EER and the clean energy utilization rate, respectively;

Step 6. implementing floor radiant heating at a heating terminal form of the combined heating system, constructing a heating parameter prediction model based on characteristics of the heating terminal form, and performing calculation in a constant flow control method to obtain an actual operation water supply temperature $t_g$, an actual operation return water temperature $t_h$ and a heating load Q at different outdoor temperatures; and Step 7. determining whether the operation of an air-source heat pump alone can meet the requirement of the heating load at the current outdoor temperature in real time, by taking the priority of meeting the heating requirement as a principle; if the air-source heat pump cannot meet the requirement, respectively calculating the comprehensive objective function in a combined operation mode of the air-source heat pump and gas-fired heater, and the comprehensive objective function in an operation mode of the gas-fired heater alone, whichever the comprehensive objective function is greater; and if the air-source heat pump can meet the requirement of the heating load, calculating the comprehensive objective function in an operation mode of the air-source heat pump alone, and the comprehensive objective function in the operation mode of the gas-fired heater alone, respectively, whichever the comprehensive objective function is greater, and based on the operation mode with the greater comprehensive objective function, obtaining an operation control strategy of the air-source heat pump and gas-fired heater combined heating system.

The present disclosure has the following beneficial effects:

(1) The present disclosure, aimed at the air-source heat pump and gas-fired heater combined heating system, constructs the heating capacity and energy consumption model for the air-source heat pump under a frosting condition and a non-frosting condition, and the heating capacity and energy consumption model for the gas-fired heater at different load rates, and based on this, performs simulated calculation on the operation performance of the combined heating system.

(2) The present disclosure provides the optimal operation control method of the combined heating system, which takes a plurality of indexes: energy conservation, environmental protection, economical efficiency and the like, as objective functions to determine the optimal operation control method of the combined heating system, thereby improving the energy utilization efficiency of the combined heating system, saving the operation cost and realizing the high efficiency, energy conservation and environmental protection of the combined heating system during operation.

(3) The present disclosure determines the weight of each evaluation index through the analytic hierarchy process, and constructs the comprehensive objective functions by performing dimensionless processing and direction unifying on each evaluation index, thereby optimizing the operation control method and solving the problem of determining the operation control method of the combined heating system under a plurality of optimization objective functions.

DETAILED DESCRIPTION OF THE EMBODIMENTS

The present disclosure will be further described below with reference to drawings and embodiments. The specific embodiments described herein are only for explaining the present disclosure, but are not for limiting the scope of protection of the present disclosure.

An optimal operation control method of the present disclosure mainly solves the optimal control of a combined heating system, provides comprehensive evaluation indexes of the combined heating system, determines a weight of each evaluation index through an analytic hierarchy process, defines comprehensive objective functions, and determines the operation control method of the combined heating system with the maximum comprehensive objective function as an optimizing purpose.

Figure 1:
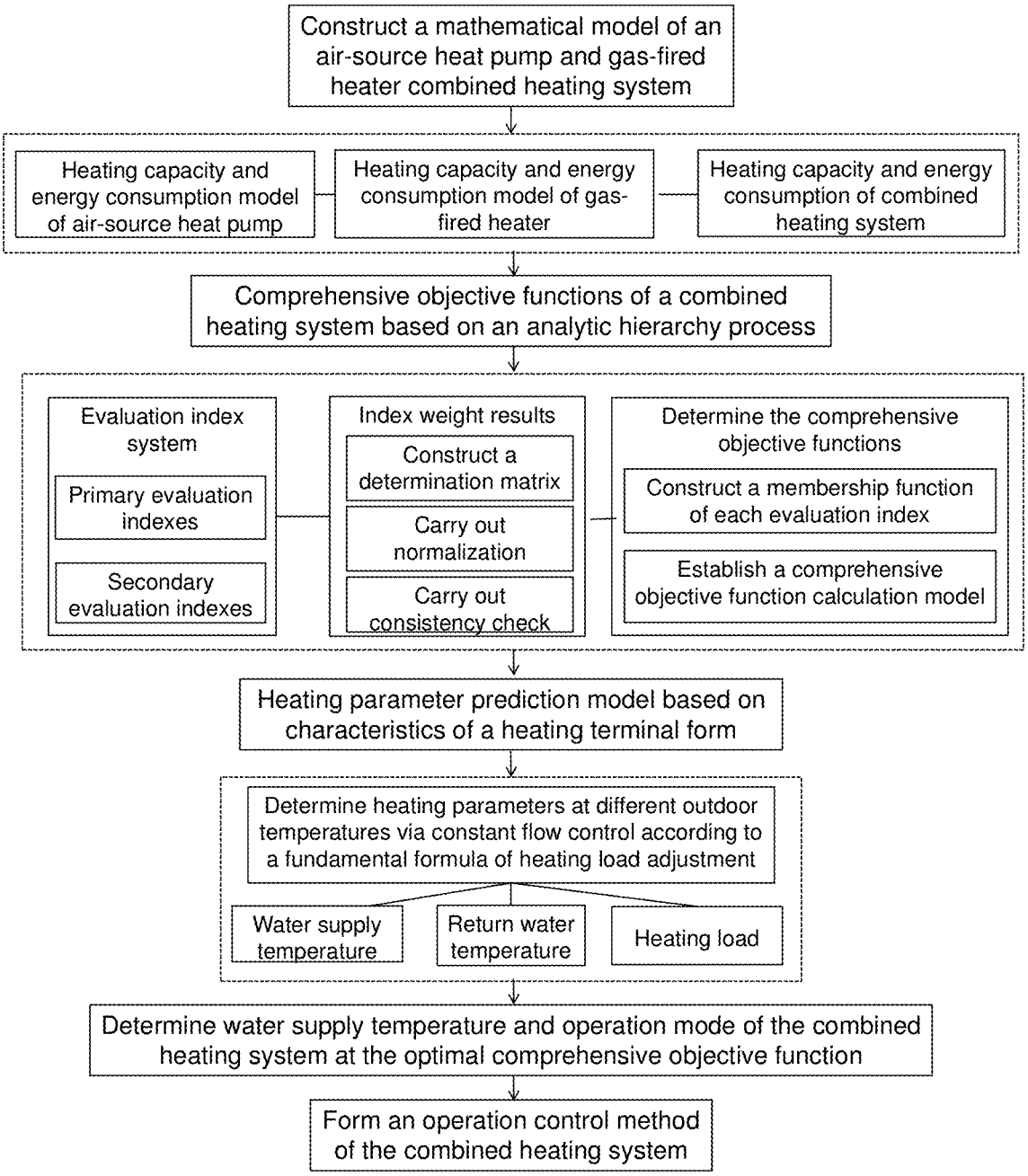
FIG. 1 is a flow block diagram illustrating an optimal operation control method of an air-source heat pump and gas-fired heater combined heating system according to the present disclosure.

FIG. 1 is a flow block diagram illustrating an optimal operation control method of an air-source heat pump and gas-fired heater combined heating system according to the present disclosure. As shown in FIG. 1, the optimal operation control method of the air-source heat pump and gas-fired heater combined heating system according to the present disclosure includes the following steps:

Step 1. a mathematical model of the air-source heat pump and gas-fired heater combined heating system is constructed, and hourly operation performance of the combined heating system is calculated, wherein the mathematical model includes a heating capacity and energy consumption model for an air-source heat pump unit, and a heating capacity and energy consumption model for a gas-fired heater unit;

a calculation formula of a heating capacity of the air-source heat pump unit is as follows:

$$Q_p = \begin{cases} Q_{rate} & \text{when the air-source heat pump is under a non-frosting condition} \\ Q_{real} & \text{when the air-source heat pump is under a frosting condition and the defrosting condition} \end{cases} \quad (1)$$

a calculation formula of power consumption of the air-source heat pump unit is as follows:

$$W_p = \begin{cases} W_{rate} & \text{when the air-source heat pump is under the non-frosting condition} \\ W_{real} & \text{when the air-source heat pump is under a frosting condition and the defrosting condition} \end{cases} \quad (2)$$

Where $Q_p$ is the heating capacity of the air-source heat pump unit, W; $Q_{rate}$ is the heating capacity of the air-source heat pump unit under the non-frosting condition, W; $Q_{real}$ is the heating capacity of the air-source heat pump unit under the frosting condition and the defrosting condition, W; $W_p$ is the power consumption of the air-source heat pump unit, W; $W_{rate}$ is the power consumption of the air-source heat pump unit under the non-frosting condition, W; and $W_{real}$ is the power consumption of the air-source heat pump unit under the frosting condition, W.

Data fitting is carried out according to the air-source heat pump heating performance curve provided by a manufacturer to obtain the heating capacity $Q_{rate}$, coefficient of performance $COP_{rate}$ and power consumption $W_{rate}$ of the air-source heat pump unit under the non-frosting condition, wherein calculation formulas are as follows:

$$Q_{rate} = a_0 + a_1 t_a + a_2 t_a^2 + a_3 t_a^3 \quad (3)$$

$$COP_{rate} = a_4 + a_5 t_a + a_6 t_a^2 + a_7 t_a^2 \quad (4)$$

$$W_{rate} = \frac{Q_{rate}}{COP_{rate}} \quad (5)$$

Where $Q_{rate}$ is the heating capacity of the air-source heat pump unit under the non-frosting condition, W; $COP_{rate}$ is the coefficient of performance of the air-source heat pump unit under the non-frosting condition; $W_{rate}$ is the power consumption of the air-source heat pump unit under the non-frosting condition, W; $t_a$ is an ambient temperature, ° C.; and $a_0$, $a_1$, $a_2$, $a_3$, $a_4$, $a_5$, $a_6$, and $a_7$ are coefficients of a fitting equation.

According to a heat pump heating capacity correction model under the frosting and defrosting conditions proposed by the related reference (Energy & Buildings, An equivalent temperature drop method for evaluating the operating performances of ASHP units jointly affected by ambient air temperature and relative humidity, Volume 224, Oct. 1, 2020, 110211), the heating capacity, $Q_{real}$, of the air-source heat pump unit under the frosting condition and the defrosting condition is obtained, wherein a calculation formula is as follows:

$$Q_{real}=Q_{rate}[0.311t_a+0.043t_a^2+0.005t_a^3-(0.783-1.072\times10^{-4}t_a^3)RH^{0.846}-1.647] \quad (6)$$

Where $Q_{real}$ is the heating capacity of the air-source heat pump unit under the frosting condition and the defrosting condition, W; $Q_{rate}$ is the heating capacity of the air-source heat pump unit under the non-frosting condition, W; $t_a$ is the ambient temperature, ° C.; and RH is a relative ambient humidity, %.

Similarly, according to a heat pump coefficient-of-performance correction model under the frosting condition proposed by the related reference (Energy & Buildings, Towards low carbon homes-A simulation analysis of building-integrated air-source heat pump systems, Volume 48, May 1, 2012, pages 127-136), the coefficient of performance, $COP_{real}$, of the air-source heat pump unit under the frosting condition and the defrosting condition is obtained, respectively, when the outdoor temperature is higher and not higher than 7° C., wherein a calculation formula is as follows:

$$COP_{real}=\begin{cases} COP_{rate}\left(1-0.1801\times e^{-\frac{t_a^2}{5}}\right), & t_a>7 \\ COP_{rate}\left[1-0.0027(t_a-7)-0.1801\times e^{-\frac{t_a^2}{5}}\right], & t_a\le 7 \end{cases} \quad (7)$$

Where $COP_{real}$ is the coefficient of performance of the air-source heat pump unit under the frosting condition and the defrosting condition; $COP_{rate}$ is the coefficient of performance of the air-source heat pump unit under the non-frosting condition; and $t_a$ is the ambient temperature, ° C.

Based on this, the power consumption, $W_{real}$, of the air-source heat pump unit under the frosting condition and the defrosting condition is obtained, wherein a calculation formula is as follows:

$$W_{real}=\frac{Q_{real}}{COP_{real}} \quad (8)$$

Where $W_{real}$ is the power consumption of the air-source heat pump unit under the frosting condition and the defrosting condition, W; $Q_{real}$ is the heating capacity of the air-source heat pump unit under the frosting condition and the defrosting condition, W; and $COP_{real}$ is the coefficient of performance of the air-source heat pump unit under the frosting condition and the defrosting condition.

A calculation formula of the gas consumption per second, $V_g$, of the heating capacity and energy consumption model for the gas-fired heater unit, is as follows:

$$V_g=Q_b/(H_i\cdot\eta_b) \quad (9)$$

Where $V_g$ is the gas consumption per second, $m^3/s$, of the gas-fired heater unit; $Q_b$ is the heating capacity of the gas-fired heater unit, W; $H_i$ is a calorific value, $J/m^3$, of fired gas fed into the gas-fired heater; and $\eta_b$ is the heat efficiency of the gas-fired heater, %.

Wherein a calculation formula of $Q_b$ is as follows:

$$Q_b=\begin{cases} Q-Q_p \text{ in the event of combined operation of the gas-fired heater and the air-source heat pump} \\ Q \text{ in the event of the operation of the gas-fired heater alone} \end{cases} \quad (10)$$

Where Q is an actual heating load, W; and $Q_p$ is the heating capacity of the air-source heat pump unit, W.

Data fitting is carried out according to a load-heat efficiency operation curve provided by a manufacturer of the gas-fired heater to obtain the operation heat efficiency ($\eta_b$) of the gas-fired heater unit at different load rates, wherein calculation formulas are as follows:

$$\eta_b=a_8+a_9\beta_b+a_{10}\beta_b^2+a_{11}\beta_b^3 \quad (11)$$

$$\beta_b=\frac{Q_b}{Q_{b0}} \quad (12)$$

Where $\eta_b$ is the operation heat efficiency of the gas-fired heater unit, %,; $a_8$, $a_9$, $a_{10}$, and $a_{11}$ are coefficients of a fitting equation; $\beta_b$ is a load rate of the gas-fired heater unit; $Q_b$ is the heating capacity of the gas-fired heater unit, W; and $Q_{b0}$ is the rated heating capacity of the gas-fired heater unit, W.

Step 2. a comprehensive evaluation index system of the combined heating system is determined, wherein the comprehensive evaluation index system includes primary evaluation indexes and secondary evaluation indexes, and a secondary evaluation index calculation model is constructed; and 3 primary evaluation indexes are provided, including energy conservation, environmental protection and economical efficiency, and 4 secondary evaluation indexes are provided, including a comprehensive energy efficiency ratio (EER) and a clean energy utilization rate η that are subordinate to the energy conservation index, a carbon dioxide emission $T_{CO2}$ that is subordinate to the environment protection index, and operation cost $C_r$ that is subordinate to the economical efficiency index.

A calculation formula of the EER of the combined heating system is as follows:

$$EER=\frac{Q_p+Q_b}{W_P/\beta_e+V_g\cdot H_i} \quad (13)$$

A calculation formula of the clean energy utilization rate η of the combined heating system is as follows:

$$\eta=\frac{Q_p}{Q_p+Q_b} \quad (14)$$

A calculation formula of the carbon dioxide emission ($T_{CO2}$) of the combined heating system is as follows:

$$T_{CO2}=T_b+T_p \tag{15}$$

$$T_b=V_g\times a_b \tag{16}$$

$$T_p=W_p\times a_p \tag{17}$$

A calculation formula of the operation cost $C_r$ of the combined heating system is as follows:

$$C_r=W_p\times P_e/(3.6\times10^6)+V_g\times P_g \tag{18}$$

Where $W_p$ is the power consumption of the air-source heat pump unit, W; $\beta_e$ is the power generation efficiency of a gas-fired device, which is 40%; $T_{CO2}$ is the carbon dioxide emission of the combined heating system, kg/s; $T_b$ is the carbon dioxide emission of the gas-fired heater unit, kg/s; $T_p$ is the carbon dioxide emission of the air-source heat pump unit, kg/s; $a_b$ is a conversion coefficient of the gas consumption to the carbon dioxide emission of the gas-fired heater, which is 1.964 kg/m$^3$; $a_p$ is a conversion coefficient of the power generation capacity to the carbon dioxide emission, which is 0.728 kg/kWh; $C_r$ is the operation cost, Yuan/s; $P_e$ is an electricity price, Yuan/kWh; and $P_g$ is a fired gas price, Yuan/m$^3$.

Step 3. an index determination matrix is constructed through an analytic hierarchy process based on the evaluation index system of the combined heating system, normalization and consistency check are carried out, and respective weights, $W_i$, of the primary evaluation indexes and the secondary evaluation indexes are determined.

The following examples will illustrate the specific steps of the present disclosure:

Firstly, an expert questionnaire survey is conducted to determine and analyze the importance of the primary evaluation indexes, which is divided into nine levels, pairwise comparisons among the primary evaluation indexes are then performed, and based on the importance from each pairwise comparison among the primary indexes, a determination matrix for the primary evaluation indexes for evaluation of the combined heating system is constructed, where levels 1, 3, 5, 7, and 9 represent that the two primary evaluation indexes are equally important, slightly important, quite important, obviously important and absolutely important, respectively, and levels 2, 4, 6, and 8 represent importance between two adjacent importance levels of the indexes. The indexes that are considered relatively less important are assigned reciprocal values, such as ⅓, ⅕, ⅐, and ⅑. A determination matrix for the secondary indexes is constructed in the same method.

The determination matrix is as follows:

$$A=(A_{ij})_{n\times n} \tag{19}$$

Where $A_{ij}$ is an element of the determination matrix A, a scale indicating the importance degree of a factor i and a factor j relative to each other, and n is an order of the determination matrix A, namely the number of the primary evaluation indexes or the secondary evaluation indexes.

Secondly, normalization is carried out, i.e., calculating a product of elements of the determination matrix at every row, then calculating the nth root of the product, and finally carrying out normalization, wherein calculation formulas are as follows:

$$M_i=\prod_{j=1}^{n}A_{ij} \tag{20}$$

-continued $$m_i=\sqrt[n]{M_i} \tag{21}$$

$$W_i=\frac{m_i}{\sum_{i=1}^{n}m_i} \tag{22}$$

Where $M_i$ is a product of elements of the determination matrix A at the $i^{th}$ row; n is an order of the determination matrix A, namely the number of the primary evaluation indexes or the secondary evaluation indexes; $A_{ij}$ is an element of the determination matrix A; $m_i$ is the nth root of the product of the determination matrix A at the $i^{th}$ row (the nth root equals to the order of the determination matrix; n is the number of the primary evaluation indexes in the event of the calculation of the weights of the primary evaluation indexes, and n is the number of the secondary evaluation indexes in the event of the calculation of the weights of the secondary evaluation indexes); and $W_i$ is the weight of the $i^{th}$ evaluation index.

Thirdly, a maximum eigenvalue $\lambda_{max}$ of the determination matrix based on the weight $W_i$ obtained in the above step, and the consistency check is carried out on the determination matrix, wherein calculation formulas are as follows:

$$R=A\times W \tag{23}$$

$$\lambda_{max}=\sum_{i=1}^{n}\frac{R_i}{nW_i} \tag{24}$$

$$C_1=\frac{\lambda_{max}-n}{n-1} \tag{25}$$

$$C_R=\frac{c_I}{R_I} \tag{26}$$

Where R is a newly constructed matrix (n×1); A is a determination matrix; W is a weight matrix (n×1) of the evaluation indexes; $\lambda_{max}$ is the maximum eigenvalue; $R_i$ is the $i^{th}$ element of the newly constructed matrix R; $C_I$ is a consistency index; $C_R$ is a consistency ratio; $R_I$ is a random consistency index, and when n is 1, 2, 3, 4, 5, 6, 7, 8, and 9, $R_I$ is 0, 0, 0.58, 0.90, 1.12, 1.24, 1.32, 1.41, and 1.45, respectively.

The consistency check is satisfied when the calculated consistency ratio $C_R$ is less than 0.1.

Step 4. The secondary evaluation indexes of the combined heating system are normalized, and calculation formulas of membership functions of EER, clean energy utilization rate, carbon dioxide emission and operation cost are as follows:

$$f_1(EER)=\begin{cases}0 & EER<EER_{min}\\ \dfrac{EER-EER_{min}}{EER_{max}-EER_{min}} & EER_{min}\le EER<EER_{max}\\ 1 & EER\ge EER_{max}\end{cases} \tag{27}$$

$$f_2(\eta)=\begin{cases}0 & \eta<\eta_{min}\\ \dfrac{\eta-\eta_{min}}{\eta_{max}-\eta_{min}} & \eta_{min}\le\eta<\eta_{max}\\ 1 & \eta\ge\eta_{max}\end{cases} \tag{28}$$

$$f_3(T_{CO2})=\begin{cases}1 & T_{CO2}\ge T_{CO2_{max}}\\ \dfrac{T_{CO2_{max}}-T_{CO_2}}{T_{CO2_{max}}-T_{CO2_{min}}} & T_{CO2_{min}}\le T_{CO2}<T_{CO2_{max}}\\ 0 & T_{CO2}<T_{CO2_{min}}\end{cases} \tag{29}$$

-continued $$f_4(C_r) = \begin{cases} 1 & C_r \geq C_{r_{max}} \\ \dfrac{c_{r_{max}} - c_r}{c_{r_{max}} - c_{r_{min}}} & C_{r_{min}} \leq C_r < C_{r_{max}} \\ 0 & C_r < C_{r_{min}} \end{cases} \tag{30}$$

Where $EER_{max}$ and $EER_{min}$ are EERs of the combined heating system in the optimal operation state and the worst operation state, respectively; $\eta_{max}$ and $\eta_{min}$ represent clean energy utilization rates of the combined heating system in the optimal operation state and the worst operation state, respectively; $T_{CO2max}$ and $T_{CO2min}$ are carbon dioxide emissions of the combined heating system in the worst operation state and the optimal operation state, respectively; and $C_{max}$ and $C_{rmin}$ are operation costs of the combined heating system in the worst operation state and the optimal operation state, respectively.

When $f_1(EER)$ and $f_2(\eta)$ are 1, the combined heating system is in the optimal operation state, and calculated values of the EER and the clean energy utilization rate $\eta$ are the maximum; and when $f_1(EER)$ and $f_2(\eta)$ are 0, the combined heating system is in the worst operation state, and calculated values of the EER and the clean energy utilization rate $\eta$ are the minimum.

When $f_3(T_{CO2})$ and $f_4(C_r)$ are 1, the combined heating system is in the worst operation state, and calculated values of the carbon dioxide emission $T_{CO2}$ and the operation cost $C_r$ are the maximum; and when $f_3(T_{CO2})$ and $f_4(C_r)$ are 0, the combined heating system is in the optimal operation state, and calculated values of the carbon dioxide emission $T_{CO2}$ and the operation cost $C_r$ are the minimum.

Step 5. a comprehensive objective function calculation model is constructed based on the membership functions of the secondary evaluation indexes, wherein a calculation formula is as follows:

$$f = w_1(w_{11} \times f_1(EER) + w_{12} \times f_2(\eta)) + w_2 \times f_3(T_{CO2}) + W_3 \times f_4(C_r) \tag{31}$$

Where $w_1$, $w_2$ and $w_3$ are the weights of the primary evaluation indexes: energy conservation, environmental protection and economical efficiency, respectively; and $w_{11}$ and $w_{12}$ are the weights of the secondary evaluation indexes: the EER and the clean energy utilization rate, respectively.

Step 6. floor radiant heating is implemented at a heating terminal form of the combined heating system, a heating parameter prediction model is constructed based on characteristics of the heating terminal form, and an actual operation water supply temperature $t_g$, an actual operation return water temperature $t_h$ and a heating load Q at different outdoor temperatures are obtained through calculation in a constant flow control method that only the water supply temperature of a network is changed at a heat source, while the circulation flow rate of the network remains constant at a design level, wherein formulas are as follows:

$$\begin{cases} t_g = t_n + 0.5(t'_g + t'_h - 2t_n)\overline{Q}^{\frac{1}{1+C_1}} + 0.5(t'_g - t'_h)\overline{Q} \\ t_g = t_n + 0.5(t'_g + t'_h - 2t_n)\overline{Q}^{\frac{1}{1+C_1}} + 0.5(t'_g - t'_h)\overline{Q} \end{cases} \tag{32}$$

$$Q = Q_{ratio} \times Q' \tag{33}$$

$$Q_{ratio} = \frac{t_n - t_a}{t_n - t'_a} \tag{34}$$

The derivation process of the above formula is as follows:

For the convenience of analysis and calculation, a basic formula for achieving a heating adjustment in the heating load is as follows, assuming that the heating load of the air-source heat pump and gas-fired heater combined heating system is in direct proportion to a change in an indoor and outdoor temperature difference:

$$Q_{ratio} = \frac{t_n - t_a}{t_n - t'_a} = \frac{(t_g + t_h - 2t_n)^{1+C_1}}{(t'_g + t'_h - 2t_n)^{1+C_1}} = G_{ratio}\frac{t_g - t_h}{t'_g - t'_n} \tag{35}$$

Where $t_n$ is a calculated indoor heating temperature, ° C., which is set to 18° C.; $t'_a$ is a calculated outdoor heating temperature, ° C., which can be found in design manuals (Lu Yaoqing, Practical Heating and Air Conditioning Design Manual (in Chinese), China Architecture & Building Press, 2nd Edition, p. 187), with −7° C. for Tianjin; $t_a$ is an outdoor ambient temperature, ° C., which derives from input outdoor meteorological data; $t'_g$ is a designed water supply temperature, ° C.; $t'_h$ is a designed return water temperature, ° C.; $t_g$ is an actual operation water supply temperature, ° C.; $t_h$ is an actual operation return water temperature, ° C.; $c_1$ is a characteristic parameter of a radiant panel in floor radiant heating, which is set to 0.3; Q' is a designed heating load; $Q_{ratio}$ is a relative heating load ratio; and $G_{ratio}$ is a relative flow rate ratio.

With the constant flow control method, namely, a ratio of the circulation flow rate to the designed circulation flow rate is 1, $G_{ratio}=1$ is substituted into the formula (35), and the actual operation water supply temperature, $t_g$ and the actual operation return water temperature, $t_h$, at different outdoor temperatures can be obtained, as shown in the calculation formulas (32).

Figure 2:
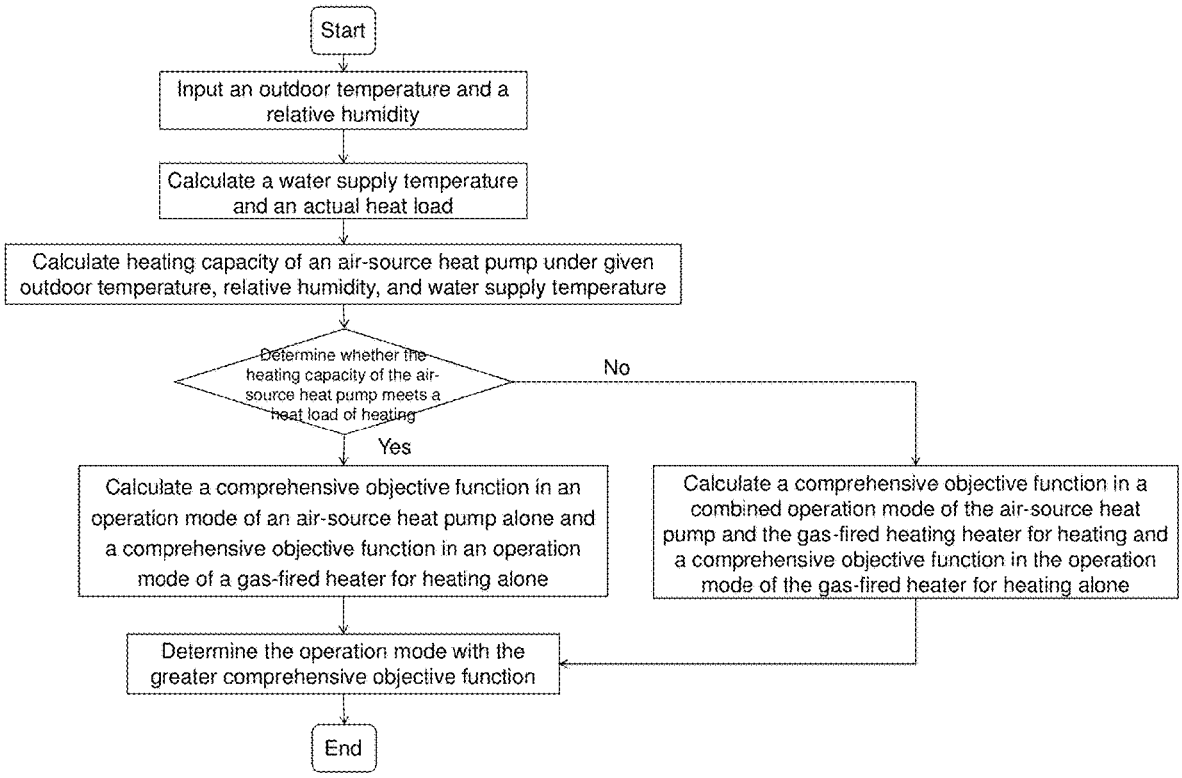
FIG. 2 is a flow block diagram illustrating determination of an operation mode of a combined heating system.

Step 7. In an operation mode of the combined heating system, as shown in FIG. 2, it is determined whether the operation of the air-source heat pump alone can meet the requirement of the heating load at the current outdoor temperature in real time, by taking the priority of meeting the heating requirement as a principle, if not, the comprehensive objective function in a combined operation mode of the air-source heat pump and the gas-fired heater, and the comprehensive objective function in an operation mode of the gas-fired heater alone are respectively calculated, whichever the comprehensive objective function is greater; and if the air-source heat pump can meet the requirement of the heating load, the comprehensive objective function in an operation mode of the air-source heat pump alone and the comprehensive objective function in the operation mode of the gas-fired heater alone are calculated, respectively, whichever the comprehensive objective function is greater, and based on the operation mode with the greater comprehensive objective function, an operation control strategy of the air-source heat pump and gas-fired heater combined heating system is obtained.

Embodiment 1

Taking a residential building in Tianjin City as an example, an operation control method of an air-source heat pump and gas-fired heater combined heating system to be employed is optimally designed, and a designed heating load is 8 kW. Taking meteorological data on a typical day as an example for calculation and analysis, wherein an air-source heat pump used for a heat source device has a rated heating capacity of 7.5 kW, and rated power of 1.85 kW; and a gas-fired heater used for the heat source device has rated heat input power of 20 kW, rated heat output power of 18 kW, and rated heat efficiency of 91.41%.

(1) Mathematical model of air-source heat pump and gas-fired heater combined heating system ① Mathematical Model of Air-Source Heat Pump A calculation formula of the heating capacity of an air-source heat pump unit is as follows:

$$Q_p = \begin{cases} Q_{rate} & \text{when an air-source heat pump is under a non-frosting condition} \\ Q_{real} & \text{when the air-source heat pump is under a frosting condition and the defrosting condition} \end{cases}$$

A calculation formula of the power consumption of the air-source heat pump unit is as follows:

$$W_p = \begin{cases} W_{rate} & \text{when the air-source heat pump is under the non-frosting condition} \\ W_{real} & \text{when the air-source heat pump is under the frosting condition and the defrosting condition} \end{cases}$$

Data fitting is carried out according to operation performance curves provided by an air-source heat pump manufacturer, 3 water outlet temperatures can be set for the air-source heat pump, which are 45° C., 50° C. and 55° C., respectively, the operation performance curves are different at different temperatures, and specific fitting results are as follows:

When the water supply temperature is 45° C., fitting formulas of the heating capacity and COP are as follows:

$$Q_{rate}=-0.1281t_a^3+4.1075t_a^2+160.9t_a+4017.4 \quad R^2=0.9636$$

$$COP_{rate}=-0.00004t_a^3+0.0011t_a^2+0.0821t_a+2.7904 \quad R^2=0.9704$$

When the water supply temperature is 50° C., fitting formulas of the heating capacity and the COP are as follows:

$$Q_{rate}=-0.1182t_a^3+3.4609t_a^2+167.45t_a+3992.4 \quad R^2=0.9707$$

$$COP_{rate}=-0.00003t_a^3+0.0007t_a^2+0.0811t_a+2.6557 \quad R^2=0.9777$$

When the water supply temperature is 55° C., fitting formulas of the heating capacity and the COP are as follows:

$$Q_{rate} = -0.1738t_a^3 + 6.2669t_a^2 + 149.21t_a + 3671.1 \quad R^2 = 0.9408$$

$$COP_{rate} = -0.00003t_a^3 + 0.001t_a^2 + 0.0722t_a + 2.4966 \quad R^2 = 0.9766$$

$$W_{rate} = \frac{Q_{rate}}{COP_{rate}}$$

Where $Q_{rate}$ is the heating capacity of the air-source heat pump unit under the non-frosting condition, W; $COP_{rate}$ is a coefficient of performance of the air-source heat pump unit under the non-frosting condition; $W_{rate}$ is power consumption of the air-source heat pump unit under the non-frosting condition, W; and $t_a$ is the outdoor ambient temperature, ° C.

According to a correction model of the heating capacity of the air-source heat pump under the frosting condition and the defrosting condition provided by a related reference, the heating capacity, $Q_{real}$, of the air-source heat pump unit under the frosting condition and the defrosting condition is obtained, wherein a calculation formula is as follows:

$$Q_{real}=Q_{rate}[0.311t_a+0.043t_a^2+0.005t_a^3-(0.783-1.072\times10^{-4}t_a^3)RH^{0.846}-1.647]$$

Where $Q_{reaL}$ is the heating capacity of the air-source heat pump unit under the frosting condition, W; $Q_{rate}$ is the heating capacity of the air-source heat pump unit under the non-frosting condition, W; $t_a$ is the outdoor ambient temperature, ° C.; and RH is the relative ambient humidity, %.

Similarly, according to a correction model of the coefficient of performance of the air-source heat pump under the frosting condition provided by a related reference, coefficient of performance, $COP_{real}$, of the air-source heat pump unit under the frosting condition and the defrosting condition is obtained when the outdoor temperature is higher and not higher than 7° C., wherein a calculation formula is as follows:

$$COP_{real} = \begin{cases} COP_{rate}\left(1-0.1801\times e^{-\frac{t_a^2}{5}}\right), & t_a > 7 \\ COP_{rate}\left[1+0.0027(t_a-7)-0.1801\times e^{-\frac{t_a^2}{5}}\right], & t_a \le 7 \end{cases}$$

Where $COP_{real}$ is the coefficient of performance of the air-source heat pump unit under the frosting condition; $COP_{rate}$ is the coefficient of performance of the air-source heat pump unit under the non-frosting condition; and $t_a$ is the outdoor ambient temperature, ° C.

Based on this, the power consumption, $W_{real}$, of the air-source heat pump unit under the frosting condition and the defrosting condition is obtained, wherein a calculation formula is as follows:

$$W_{real} = \frac{Q_{real}}{COP_{real}}$$

Where $W_{real}$ is the power consumption of the air-source heat pump unit under the frosting condition, W; $Q_{rate}$ is the heating capacity of the air-source heat pump unit under the frosting condition, W; and $COP_{real}$ is the coefficient of performance of the air-source heat pump unit under the frosting condition.

② Mathematical Model of Gas-Fired Heater

A calculation formula of a heating capacity and energy consumption model for the gas-fired heater unit, namely gas consumption per second, $V_g$, of the gas-fired heater unit, is as follows:

$$V_9=Q_b/(H_i\cdot\eta_b)$$

Where $V_g$ is the gas consumption per second of the gas-fired heater unit, $m^3/s$; $Q_b$ is the heating capacity of the gas-fired heater unit, W; $H_i$ is the calorific value of fired gas fed into the gas-fired heater, $J/m^3$; and $\eta_b$ is the heat efficiency of the gas-fired heater, %.

Wherein a calculation formula of $Q_b$ is as follows:

$$Q_b = \begin{cases} Q - Q_p & \text{in the event of combined operation of the gas-fired heater and the air-source heat pump} \\ Q & \text{in the event of the operation of the gas-fired heater alone} \end{cases}$$

Where Q is an actual heating load, kW; and $Q_p$ is the heating capacity of the air-source heat pump unit, W.

Data fitting is carried out according to an operation performance curve provided by a manufacturer of the gas-fired heater to obtain the operation heat efficiency $\eta_b$ of the gas-fired heater unit at different load rates, wherein a calculation formula is as follows:

$$\eta_b = 66.819 + 80.252 \cdot \beta_b - 93.267 \cdot \beta_b^2 + 37.677 \cdot \beta_b^3 R^2 = 0.979$$

$$\beta_b = \frac{Q_b}{Q_{b0}}$$

Where $\eta_b$ is the operation heat efficiency of the gas-fired heater unit, %; $\beta_b$ is a load rate of the gas-fired heater unit; $Q_b$ is the heating capacity of the gas-fired heater unit, W; and $Q_{b0}$ is the rated heating capacity of the gas-fired heater unit, W.

(2) Calculation Model of Evaluation Index

A comprehensive evaluation index system of the combined heating system includes primary evaluation indexes and secondary evaluation indexes, wherein 3 primary evaluation indexes are provided, including energy conservation, environmental protection and economical efficiency, and 4 secondary evaluation indexes are provided, including EER and a clean energy utilization rate ($\eta$) that are subordinate to the energy conservation index, a carbon dioxide $T_{CO2}$ that is subordinate to the environment protection index, and operation cost $C_r$ that is subordinate to the economical efficiency index.

A calculation formula of the EER of the combined heating system is as follows:

$$EER = \frac{Q_p + Q_b}{W_P/\beta_e + V_g \cdot H_i}$$

Where $\beta_b$ is power generation efficiency of the gas-fired device, which is set to 40%;

A calculation formula of the clean energy utilization rate ($\eta$) of the combined heating system is as follows:

$$\eta = \frac{Q_p}{Q_p + Q_b}$$

Calculation formulas of the carbon dioxide emission, $T_{CO2}$, of the combined heating system are as follows:

$$T_{CO2} = T_b + T_p$$

$$T_b = V_9 \times a_b$$

$$T_p = W_p \times a_p$$

Where $T_{CO2}$ is the carbon dioxide emission of the combined heating system, kg/s; $T_b$ is the carbon dioxide emission of the gas-fired heater unit, kg/s; $T_P$ is the carbon dioxide emission of the air-source heat pump unit, kg/s; $a_b$ is the conversion coefficient of the gas consumption to the carbon dioxide emission of the gas-fired heater, which is 1.964 kg/m$^3$; and $a_p$ is a conversion coefficient of the power generation capacity to the carbon dioxide emission, which is 0.728 kg/kWh, so that carbon dioxide emission is obtained, which is $0.2\times10^{-6}$ kg/(W·s).

A calculation formula of the operation cost, $C_r$, of the combined heating system is as follows:

$$C_r = W_p \times P_e/(3.6\times10^6) + V_g \times P_g$$

Where $C_r$ is the operation cost, yuan/s; $p_e$ is an electricity price, Yuan/kWh, which is set to 0.5 Yuan/kWh; and $p_g$ is a fired gas price, Yuan/m$^3$, which is set to 2.2 Yuan/m$^3$.

(3) Determination of Weights of Evaluation Indexes

Based on the evaluation indexes of the combined heating system, a determination matrix is constructed via an expert scoring method, and the weights of the evaluation indexes are calculated, wherein calculation results are as follows:

TABLE 1

Determination matrix of primary index

| Primary index | Energy conservation | Environmental protection | Economical efficiency | Weight |
|---|---|---|---|---|
| Energy conservation | 1 | 3 | 5 | 0.6370 |
| Environmental protection | 1/3 | 1 | 3 | 0.2583 |
| Economical efficiency | 1/5 | 1/3 | 1 | 0.1047 |

Maximum eigenvalue $\lambda_{max}$=3.0385, CI=0.0193, CR=CI/RI=0.0322<0.1, which met the consistency check.

TABLE 2

Determination matrix of secondary index

| Secondary index | EER | Clean energy utilization rate | Weight |
|---|---|---|---|
| EER | 1 | 3 | 0.75 |
| Clean energy utilization rate | 1/3 | 1 | 0.25 |

Maximum eigenvalue: $\Lambda_{max}$=2.00, CI=0, CR=CI/RI=0<0.1, which met the consistency check.

(4) Determination of Membership Function of Evaluation Index

① The EER in the system evaluation index is a ratio of total heat provided by the combined heating system to the gas consumption of the combined heating system, and the maximum value corresponds to the condition where the combined heating system is totally heated by the air-source heat pump that operates in the optimal operation state, as a result, COP is 5.70,and the power generation efficiency of the gas-fired boiler is 40%, namely EER=2.28; and the minimum value corresponds to the condition where the combined heating system is totally heated by the gas-fired heater for heating that operates in the worst operation state, namely EER=0.70, so that a membership function of the EER is determined, wherein a calculation formula is as follows:

$$f_1(EER) = \begin{cases} 0 & EER < 0.7 \\ \dfrac{EER - 0.7}{1.58} & 0.7 \le EER < 2.28 \\ 1 & EER \ge 2.28 \end{cases}$$

② The clean energy utilization rate q in the system evaluation index is a ratio of total heat provided by the air-source heat pump to the total heat provided by the combined heating system, and the maximum value corresponds to the condition where the combined heating system is totally heated by the air-source heat pump, namely $\eta=1$; and the minimum value corresponds to the condition where the combined heating system is totally heated by the gas-fired heater for heating, namely $\eta=0$, so that a membership function of the clean energy utilization rate ($\eta$) is determined, wherein a calculation formula is as follows:

$$f_2(\eta)=\eta$$

③ The carbon dioxide emission $T_{CO2}$ in the system evaluation index is the sum of the carbon dioxide emission of the gas-fired heater unit and the carbon dioxide emission of the air-source heat pump unit, and the maximum value corresponds to the condition where the combined heating system is totally heated by the gas-fired heater that operates in the worst operation state, namely, the heating capacity of the heater is 8 kW, the heat efficiency is 70%, the fired gas calorific value is $3.7\times10^7$ J/m$^3$, the gas consumption is obtained through calculation from the formula (12), which is $3.09\times10^{-4}$ m$^3$/s, and consequently, the carbon dioxide emission can be obtained through calculation based on the above conditions, which is $6.07\times10^{-4}$ kg/s; and the minimum value corresponds to the condition where the combined heating system is totally heated by the air-source heat pump that operates in the optimal operation state, namely, the heating capacity of the heat pump is 8 kW, COP is 5.70, power consumption is obtained through calculation from the formula (3), which is $1.4\times10^3$ W, and consequently, the carbon dioxide emission is obtained through calculation from the above conditions, which is $2.8\times10^{-4}$ kg/s, so that a membership function of the carbon dioxide emission $T_{CO2}$ is determined, wherein a calculation formula is as follows:

$$f_3(T_{CO2})=\begin{cases}1 & T_{CO2}\geq 6.07\times10^{-4}\\ \dfrac{6.07-T_{CO2}\times10^4}{3.27} & 2.8\times10^{-4}\leq T_{CO2}<6.07\times10^{-4}\\ 0 & T_{CO2}<2.8\times10^{-4}\end{cases}$$

④ The operation cost $C_r$ in the system evaluation index is the sum of the operation cost of the air-source heat pump and the operation cost of the gas-fired heater, and the maximum value corresponds to the condition where the combined heating system is totally heated by the gas-fired heater that operates in the worst operation state, namely, the heating capacity of the heater is 8 kW, the heat efficiency is 83%, the fired gas calorific value is $3.7\times10^7$ J/m$^3$, the gas consumption is obtained through calculation from the formula (12), which is $2.61\times10^{-4}$ m$^3$/s, the fired gas price is 2.2 Yuan/m$^3$, and consequently, the operation cost is obtained through calculation from the above conditions, which is $5.23\times10^{-4}$ Yuan/s; and the minimum value corresponds to the condition where the combined heating system is totally heated by the air-source heat pump that operates in the optimal operation state, namely, the heating capacity of the heat pump is 8 kW, COP is 5.70, power consumption is obtained through calculation from the formula (3), which is $1.4\times10^3$ W, the electricity price is 0.5 Yuan/kWh, and consequently, the operation cost is obtained through calculation from the above conditions, which is $1.95\times10^{-4}$ Yuan/s, so that a membership function of the operation cost $C_r$ is determined, wherein a calculation formula is as follows:

$$f_4(C_r)=\begin{cases}1 & C_r\geq 5.23\times10^{-4}\\ \dfrac{5.23-C_r\times10^4}{1.95} & 3.28\times10^{-4}\leq C_r<.23\times10^{-4}\\ 0 & C_r<3.28\times10^{-4}\end{cases}$$

(5) Determination of Comprehensive Objective Function Calculation Model

A Comprehensive Objective Function Calculation Model is Constructed Based on the Membership Function and Weight of the Evaluation Index at Each Level, Wherein a Calculation Formula is as Follows:

$$f=0.0637(0.75\times f_1(EER)+0.25\times f_2(\eta))+0.2583\times f_3(T_{CO2})+0.1047\times f_4(C_r)$$

(6) Determination of Heating Load

An indoor heating calculating temperature $t_n$ is 18° C., and an outdoor heating calculating temperature $t'_a$ in Tianjin City is −7° C., designed water supply and return water temperatures, $t'_g$ and $t'_h$, are 50° C. and 40° C., respectively, a designed heating load Q' is 8 kW, and consequently, a relative heating load $Q_{ratio}$ and an actual heating load Q are determined, wherein calculation formulas are as follows:

$$Q_{ratio}=\frac{18-t_a}{18-(-7)}=0.72-0.04\times t_a$$

$$Q=8\times\frac{18-t_a}{18-(-7)}=5.76-0.32\times t_a$$

With the constant flow control method, namely, a ratio of the circulation flow rate to the designed circulation flow rate of 1, a characteristic parameter $c_1$ of a radiant panel is 0.3, so that a heating and water supply temperature, a heating and water return temperature and a heating load at different outdoor temperatures are obtained, wherein calculation formulas are as follows:

$$\begin{cases}t_g=18+27\times(0.72-0.04\times t_a)^{0.77}+0.5\times(0.72-0.04\times t_a)\\ t_h=18+27\times(0.72-0.04\times t_a)^{0.77}-0.5\times(0.72-0.04\times t_a)\end{cases}$$

(7) Determination of Operation Control Strategy of Combined Heating System

It is determined whether the operation of the air-source heat pump alone can meet the requirement of the heating load at the current outdoor temperature in real time by taking the priority of meeting the heating requirement as a principle, if not, a comprehensive objective function in a combined operation mode of the air-source heat pump and the gas-fired heating heater for heating and a comprehensive objective function in an operation mode of the gas-fired heater for heating alone are respectively calculated, whichever the comprehensive objective function is greater; and if the air-source heat pump can meet the requirement of the heating load, a comprehensive objective function in an operation mode of the air-source heat pump alone and the comprehensive objective function in the operation mode of the gas-fired heater for heating alone are calculated, respectively, whichever the comprehensive objective function is greater, and based on the operation mode with the greater comprehensive objective function, an operation control strategy of the air-source heat pump and gas-fired heater combined heating system is obtained.

Taking the meteorological data of Tianjin City on a typical day during the winter season as an example, the operation control strategy for the air-source heat pump and gas-fired heater combined heating system is optimally calculated, and results are shown in the figure. Hourly meteorological data, including outdoor temperature, solar irradiance, and calculated actual water supply temperature are shown in FIG. 3, an hourly output of a heat-source device is shown in FIG. 4, and hourly evaluation indexes and comprehensive objective function values of the combined heating system are shown in FIG. 5.

Figure 3:
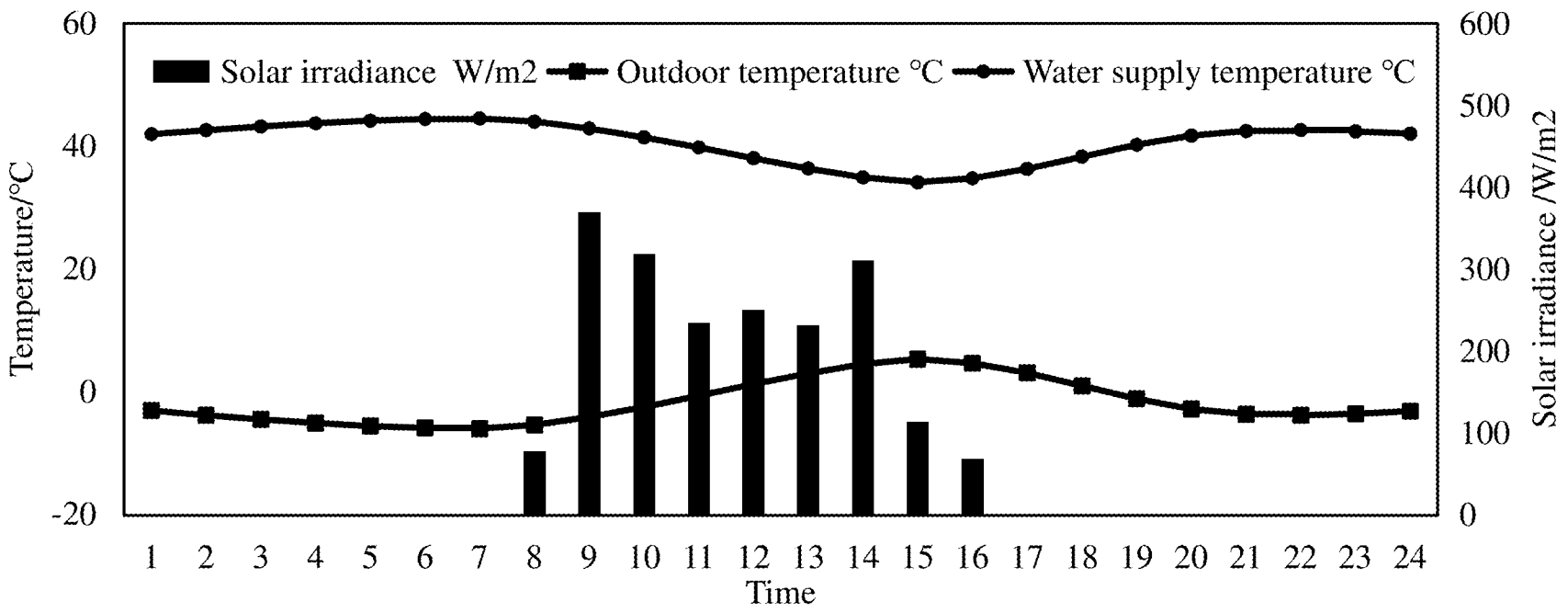
FIG. 3 is a diagram illustrating hourly meteorological data and water supply temperature in Embodiment 1.
Figure 4:
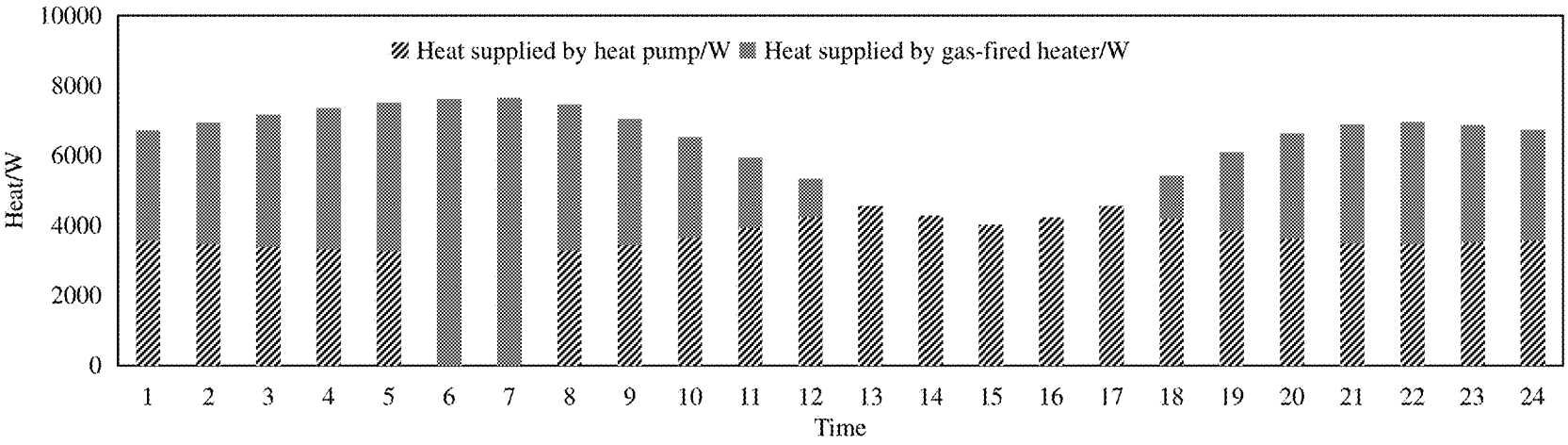
FIG. 4 is a diagram illustrating an hourly output of a heat source device in Embodiment 1.
Figure 5:
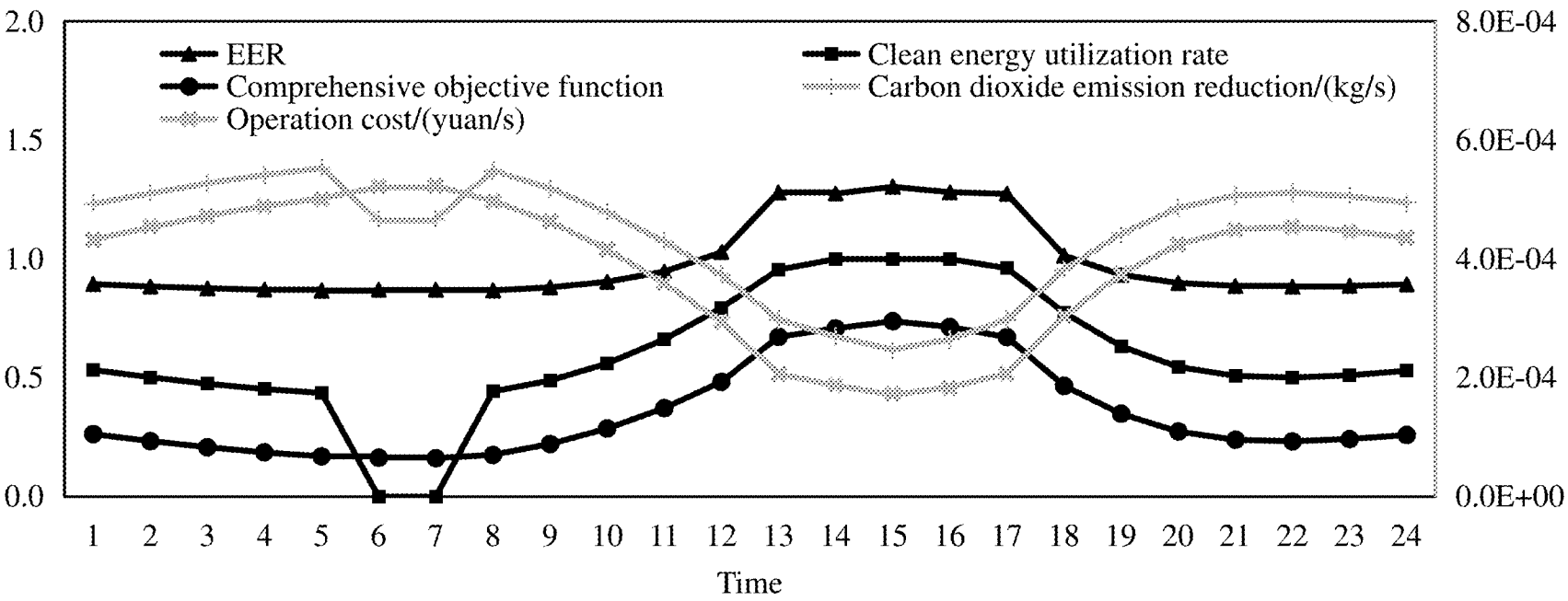
FIG. 5 is a diagram illustrating hourly evaluation indexes and comprehensive objective function values of a combined heating system in Embodiment 1.

As shown in FIG. 3, the hourly water supply temperatures of the air-source heat pump and gas-fired heater combined heating system correspond to set water supply temperatures for the air-source heat pump and the gas-fired heater for heating at different moments; as shown in FIG. 4, during the time period from 6:00 to 7:00 a.m., the outdoor temperature was relatively lower, the air-source heat pump was in the poor operation state, and therefore, the gas-fired heater operated exclusively during this time period; during the time period from 13:00 to 17:00 p.m., the outdoor temperature was relatively higher, the air-source heat pump was in the suboptimal operation state and could meet the requirements of heating load, and therefore, the air-source heat pump operated alone during this time period; and at other moments, the air-source heat pump operated together with the gas-fired heate. As shown in FIG. 5, the system evaluation index, including the EER, the clean energy utilization rate (η), and the comprehensive objective function (f), had a change trend similar to that of the outdoor temperature, i.e., initially increasing with the rise in the outdoor temperature and then decreasing as the outdoor temperature dropped. Conversely, the change trends for the carbon dioxide emissions ($T_{CO2}$) and the operation cost ($C_r$) were opposite to the change trend of the outdoor temperature, i.e., decreasing with the rise in the outdoor temperature and increasing as the outdoor temperature dropped.

It should be noted that although the preferred embodiments of the present disclosure are described above with reference to the drawings, the present disclosure is not merely limited to the above specific implementations, and the above implementations are only schematic instead of restrictive. Those skilled in the art may also make many forms without departing from the purpose of the present disclosure and the scope protected by the claims under the inspiration of the present disclosure, and these forms all belong to the scope of protection of the present disclosure.

What is claimed is:

1. An optimal operation control method of the air-source heat pump and gas-fired heater combined heating system, including the following steps:

step 1. constructing a mathematical model of the air-source heat pump and gas-fired heater combined heating system, and calculating hourly operation performance of the combined heating system; wherein the mathematical model includes a heating and energy consumption model for an air-source heat pump unit and a heating and energy consumption model for a gas-fired heater unit;

step 2. determining a comprehensive evaluation index system of the combined heating system, including primary evaluation indexes and secondary evaluation indexes, and constructing a secondary evaluation index calculation model; wherein 3 primary evaluation indexes are provided, including energy conservation, environmental protection and economical efficiency, and 4 secondary evaluation indexes are provided, including a comprehensive energy efficiency ratio (EER) and a clean energy utilization rate, η, that are subordinate to the energy conservation index, a CO2 emission TCO2 that is subordinate to the environment protection index, and operation cost Cr that is subordinate to the economical efficiency index;

a calculation formula of the EER of the combined heating system is as follows:

$$EER = \frac{Q_p + Q_b}{W_p/\beta_e + V_g \cdot H_i}$$

a calculation formula of the clean energy utilization rate, η, of the combined heating system is as follows:

$$\eta = \frac{Q_p}{Q_p + Q_b}$$

a calculation formula of the $CO_2$ emission, $T_{CO2}$, of the combined heating system is as follows: $T_{CO2}=T_b+T_p$, $T_b=V_g\times a_b$, $T_p=W_p\times a_p$;

a calculation formula of the operation cost, $C_r$, of the combined heating system is as follows:

$$C_r=W_p\times P_e/(3.6\times10^6)+V_g\times P_g$$

where $W_p$ is the power consumption of the air-source heat pump unit; $\beta_e$ is the power generation efficiency of a gas-fired device; $T_{CO2}$ is the $CO_2$ emission of the combined heating system; $T_b$ is the $CO_2$ emission of the gas-fired heater unit; $T_p$ is the $CO_2$ emission of the air-source heat pump unit; $a_b$ is a conversion coefficient of the gas consumption to the carbon dioxide emission of the gas-fired heater for heating; $\alpha_p$ is a conversion coefficient of the power generation capacity to the carbon dioxide emission; $C_r$ is the operation cost; $P_e$ is an electricity price; and $P_g$ is a fired gas price; $Q_p$ is heating capacity of the air-source heat pump unit; $Q_b$ is heating capacity of the gas-fired heater unit; $V_g$ is the gas consumption per second of the gas-fired heater unit; $H_i$ is a calorific value of fired gas fed into the gas-fired heater for heating;

step 3. constructing an index determination matrix through an analytic hierarchy process based on the evaluation index system of the combined heating system, carrying out normalization and consistency check, and determining respective weights of the primary evaluation indexes and the secondary evaluation indexes;

step 4. normalizing the secondary evaluation indexes of the combined heating system, and respectively calculating membership functions of the EER, the clean energy utilization rate, the carbon dioxide emission and the operation cost;

step 5. a comprehensive objective function calculation model is constructed based on the membership functions of the secondary evaluation indexes, with a calculation formula as follows: $f=w_1(w_{11}\times f_1(EER)+w_{12}\times f_2(\eta))+w_2\times f_3(T_{CO2})+w_3\times f_4(C_r)$, where $w_1$, $w_2$, and $w_3$ denote the weights of the primary evaluation indexes: the energy conservation, the environmental protection and the economical efficiency, respectively; and $w_{11}$ and $w_{12}$ denote the weights of the secondary evaluation indexes: the EER and the clean energy utilization rate, respectively;

step 6. implementing floor radiant heating at a heating terminal form of the combined heating system, constructing a heating parameter prediction model based on characteristics of the heating terminal form, and performing calculation in a constant flow control method to obtain an actual operation water supply temperature $t_g$, an actual operation return water temperature $t_h$ and a heating load Q at different outdoor temperatures; and step 7. determining whether the operation of an air-source heat pump alone can meet the requirement of the heating load at the current outdoor temperature in real time by taking the priority of meeting the heating requirement as a principle; if the air-source heat pump cannot meet the requirement, respectively calculating a comprehensive objective function in a combined operation mode of the air-source heat pump and a gas-fired heater for heating and a comprehensive objective function in an operation mode of the gas-fired heater for heating alone, whichever the comprehensive objective function is greater; and if the air-source heat pump can meet the requirement of the heating load, calculating a comprehensive objective function in an operation mode of the air-source heat pump alone and the comprehensive objective function in the operation mode of the gas-fired heater for heating alone, respectively, whichever the comprehensive objective function is greater, and based on the operation mode with the greater comprehensive objective function, obtaining an operation control strategy of the air-source heat pump and gas-fired heater combined heating system wherein the operation control strategy is employed to control and operate the air-source heat pump and gas-fired heater.

2. The optimal operation control method of the air-source heat pump and gas-fired heater combined heating system according to claim 1, wherein a calculation formula of a heating capacity of the air-source heat pump unit in step 1 is as follows:

$$Q_p = \begin{cases} Q_{rate} \text{ when the air-source heat pump is under a non-frosting condition} \\ Q_{real} \text{ when the air-source heat pump is under a frosting condition and the defrosting condition} \end{cases}$$

a calculation formula of power consumption of the air-source heat pump unit is as follows:

$$W_p = \begin{cases} W_{rate} \text{ when the air-source heat pump is under a non-frosting condition} \\ W_{real} \text{ when the air-source heat pump is under a frosting condition and the defrosting condition} \end{cases}$$

where $Q_p$ is the heating quantity of the air-source heat pump unit; $Q_{rate}$ is the heating quantity of the air-source heat pump unit under the non-frosting condition; $Q_{real}$ is the heating capacity of the air-source heat pump unit under the frosting condition and the defrosting condition; $W_p$ is the power consumption of the air-source heat pump unit; $W_{rate}$ is the power consumption of the air-source heat pump unit under the non-frosting condition; and $W_{real}$ is the power consumption of the air-source heat pump unit under the frosting condition;

data fitting is carried out according to an air-source heat pump heating performance curve provided by a manufacturer to obtain the heating capacity $Q_{rate}$, coefficient of performance $COP_{rate}$ and power consumption $W_{rate}$ of the air-source heat pump unit under the non-frosting condition, wherein calculation formulas are as follows:

$$Q_{rate} = a_0 + a_1 t_a + a_2 t_a^2 + a_3 t_a^3,$$

-continued $$COP_{rate} = a_4 + a_5 t_a + a_6 t_a^2 + a_7 t_a^2,$$

$$W_{rate} = \frac{Q_{rate}}{COP_{rate}};$$

where $Q_{rate}$ is the heating capacity of the air-source heat pump unit under the non-frosting condition; $COP_{rate}$ is the coefficient of performance of the air-source heat pump unit under the non-frosting condition; $W_{rate}$ is the power consumption of the air-source heat pump unit under the non-frosting condition; $t_a$ is an ambient temperature; and $a_0$, $a_1$, $a_2$, $a_3$, $a_4$, $a_5$, $a_6$, and $a_7$ are coefficients of a fitting equation;

according to a heat pump heating capacity correction model under the frosting and defrosting conditions, heating capacity $Q_{real}$ of the air-source heat pump unit under the frosting condition and the defrosting condition is obtained, wherein a calculation formula is as follows:

$$Q_{real} = Q_{rate}[0.311 t_a + 0.043 t_a^2 + 0.005 t_a^3 - (0.783 - 1.072\times10^{-4} t_a^3) RH^{0.846} - 1.647]$$

where RH is a relative ambient humidity; according to a heat pump coefficient-of-performance correction model under the frosting condition, when the outdoor temperature is higher and not higher than 7° C., performance coefficient $COP_{real}$ of the air-source heat pump unit under the frosting condition and the defrosting condition is as follows:

$$COP_{real} = \begin{cases} COP_{rate}\left(1 - 0.1801 \times e^{-\frac{t_a^2}{5}}\right), & t_a > 7 \\ COP_{rate}\left[1 + 0.0027(t_a - 7) - 0.1801 \times e^{-\frac{t_a^2}{5}}\right], & t_a \le 7 \end{cases};$$

and power consumption $W_{real}$ of the air-source heat pump unit under the frosting condition and the defrosting condition is as follows:

$$W_{real} = \frac{Q_{real}}{COP_{real}};$$

a calculation formula of the gas consumption per second $V_g$ of the heating and energy consumption model for the gas-fired heater unit, namely the gas-fired heater unit, is as follows: $V_g = Q_b/(H_i \cdot \eta_b)$; wherein $Q_b$ is the heating capacity of the gas-fired heater unit; $H_i$ is a calorific value of fired gas fed into the gas-fired heater; and $\eta_b$ is the heat efficiency of the gas-fired heater for heating;

wherein a calculation formula of $Q_b$ is as follows:

$$Q_b = \begin{cases} Q - Q_p \text{ in the event of the combined operation of the gas-fired heater and the air-source heat pump} \\ Q \text{ in the event of the operation of the gas-fired heater alone} \end{cases}$$

where Q is an actual heating load; and $Q_p$ is the heating capacity of the air-source heat pump unit;

data fitting is carried out according to a load-heat efficiency operation curve provided by a manufacturer of the gas-fired heater for heating to obtain the operation heat efficiency $\eta_b$ of the gas-fired heater unit at different load rates, wherein calculation formulas are as follows:

$$\eta_n = a_8 + a_9\beta_b + a_{10}\beta_b^2 + a_{11}\beta_b^3,\ \beta_b = \frac{Q_b}{Q_{b0}};$$

where $a_8$, $a_9$, $a_{10}$, and $a_{11}$ are coefficients of a fitting equation; $\beta_b$ is a load rate of the gas-fired heater unit; $Q_b$ is the heating capacity of the gas-fired heater unit; and $Q_{b0}$ is the rated heating capacity of the gas-fired heater unit, wherein the calculated values employed to control and operate the heat pump and gas-fired heater.

3. The optimal operation control method of the air-source heat pump and gas-fired heater combined heating system according to claim 1, wherein calculation formulas of membership functions of EER, clean energy utilization rate, carbon dioxide emission and operation cost are as follows:

$$f_1(EER) = \begin{cases} 0 & EER < EER_{min} \\ \dfrac{EER - EER_{min}}{EER_{max} - EER_{min}} & EER_{min} \le EER < EER_{max} \\ 1 & EER \ge EER_{max} \end{cases};$$

$$f_2(\eta) = \begin{cases} 0 & \eta < \eta_{min} \\ \dfrac{\eta - \eta_{min}}{\eta_{max} - \eta_{min}} & \eta_{min} \le \eta < \eta_{max} \\ 1 & \eta \ge \eta_{max} \end{cases};$$

$$f_3(T_{CO2}) = \begin{cases} 1 & T_{CO2} \ge T_{CO2_{max}} \\ \dfrac{T_{CO2_{max}} - T_{CO2}}{T_{CO2_{max}} - T_{CO2_{min}}} & T_{CO2_{min}} \le T_{CO2} < T_{CO2_{max}} \\ 0 & T_{CO2} < T_{CO2_{min}} \end{cases};$$

$$f_4(C_r) = \begin{cases} 1 & C_r \ge C_{r_{max}} \\ \dfrac{C_{r_{max}} - C_r}{C_{r_{max}} - C_{r_{min}}} & C_{r_{min}} \le C_r < C_{r_{max}} \\ 0 & C_r < C_{r_{min}} \end{cases};$$

where $EER_{max}$ and $EER_{min}$ are EERs of the combined heating system in the optimal operation state and the worst operation state, respectively; $\eta_{max}$ and $\eta_{min}$ represent clean energy utilization rates of the combined heating system in the optimal operation state and the worst operation state, respectively; $T_{CO2\ max}$ and $T_{CO2\ min}$ are carbon dioxide emissions of the combined heating system in the worst operation state and the optimal operation state, respectively; and $C_{r\ max}$ and $C_{r\ min}$ are operation costs of the combined heating system in the worst operation state and the optimal operation state, respectively;

when $f_1$ (EER) and $f_2$ ($\eta$) are 1, the combined heating system is in the optimal operation state, and calculated values of the EER and the clean energy utilization rate $\eta$ are the maximum; and when $f_1$ (EER) and $f_2$ ($\eta$) are 0, the combined heating system is in the worst operation state, and calculated values of the EER and the clean energy utilization rate $\eta$ are the minimum; when $f_3$ ($T_{CO2}$) and $f_4$ ($C_r$) are 1, the combined heating system is in the worst operation state, and calculated values of the carbon dioxide emission $T_{CO2}$ and the operation cost $C_r$ are the maximum; and when $f_3$ ($T_{CO2}$) and $f_4$ ($C_r$) are 0, the combined heating system is in the optimal operation state, and calculated values of the carbon dioxide emission $T_{CO2}$ and the operation cost $C_r$ are the minimum, wherein the calculated value employed to control and operate the heat pump and gas-fired heater.

4. The optimal operation control method of the air-source heat pump and gas-fired heater combined heating system according to claim 1, wherein the formulas in step 6 are as follows:

$$\begin{cases} t_g = t_n + 0.5(t'_g + t'_h - 2t_n)\overline{Q}^{\frac{1}{1+C_1}} + 0.5(t'_g + t'_h)\overline{Q} \\ t_h = t_n + 0.5(t'_g + t'_h - 2t_n)\overline{Q}^{\frac{1}{1+C_1}} - 0.5(t'_g + t'_h)\overline{Q} \end{cases},$$

$$Q = Q_{ratio} \times Q',\ Q_{ratio} = \frac{t_n - t_a}{t_n - t'_a};$$

where $t'_g$ is a designed water supply temperature; $t'_h$ is a designed return water temperature; $t_g$ is an actual operation water supply temperature; $t_h$ is an actual operation return water temperature; $c_1$ is a characteristic parameter of a radiant panel in floor radiant heating; $Q_{ratio}$ is a relative heating load ratio; Q' is a designed heating load; $t_n$ is a calculated indoor heating temperature; and $t'_a$ is a calculated outdoor heating temperature, wherein the calculated value employed to control and operate the air-source heat pump and gas-fired heater.

* * * * *